United States Patent [19]

Nagarajan et al.

[11] Patent Number: 5,004,557

[45] Date of Patent: Apr. 2, 1991

[54] AQUEOUS LAUNDRY DETERGENT COMPOSITIONS CONTAINING ACRYLIC ACID POLYMERS

[75] Inventors: Madukkarai K. Nagarajan, Avon Lake; Fred J. Wherley, Middleburg Heights; Jody W. Frimel, Vermillion, all of Ohio

[73] Assignee: The B. F. Goodrich Company, Brecksville, Ohio

[21] Appl. No.: 266,760

[22] Filed: Nov. 3, 1988

Related U.S. Application Data

[63] Continuation-in-part of Ser. No. 30,317, Mar. 26, 1987, abandoned, which is a continuation-in-part of Ser. No. 766,330, Aug. 16, 1985, abandoned.

[51] Int. Cl.[5] ..... C11D 3/37

[52] U.S. Cl. ..... 252/174.24; 252/173; 252/174; 252/23; 252/DIG. 2; 252/DIG. 14; 252/DIG. 15

[58] Field of Search ..... 252/174.24, 174.23, 252/DIG. 14, DIG. 2, DIG. 15, 173

[56] References Cited

U.S. PATENT DOCUMENTS

| | | | |
|---|---|---|---|
| 3,719,647 | 3/1973 | Hardy et al. | 252/112 |
| 3,782,898 | 1/1974 | Mandell, Jr. | 8/137 |
| 4,092,273 | 5/1978 | Inamorato et al. | 252/548 |
| 4,147,650 | 4/1979 | Sabatelli et al. | 252/103 |
| 4,215,004 | 7/1980 | Borgerding et al. | 252/156 |
| 4,368,147 | 1/1983 | Inamorato et al. | 252/545 |
| 4,490,271 | 12/1984 | Spadini et al. | 252/174.23 |
| 4,556,504 | 12/1985 | Rek | 252/135 |
| 4,559,159 | 12/1985 | Denzinger et al. | 252/174.24 |
| 4,559,169 | 12/1985 | Wevers et al. | 252/543 |
| 4,597,898 | 7/1986 | Vander Meer | 252/529 |
| 4,647,396 | 3/1987 | Denzinger et al. | 252/174.24 |

FOREIGN PATENT DOCUMENTS

| | | |
|---|---|---|
| 2079305 | 6/1981 | United Kingdom . |

*Primary Examiner*—Paul Lieberman
*Assistant Examiner*—A. Beadles-Hay
*Attorney, Agent, or Firm*—George A. Kap

[57] ABSTRACT

A clear or translucent liquid detergent composition that is pourable at room temperature and provides soil anti-redeposition, improved cleaning performance, and viscosity control, comprises 1 to 60% of at least one surfactant, up to 20% of a water-soluble sequester builder, 0.1 to 2% of an active agent selected from homopolymers and copolymers of acrylic acid, and enough water and other additives to make 100% of said composition.

8 Claims, No Drawings

AQUEOUS LAUNDRY DETERGENT COMPOSITIONS CONTAINING ACRYLIC ACID POLYMERS

REFERENCE TO A RELATED APPLICATION

This application is a continuation-in-part of Ser. No. 07/030,317 filed Mar. 26, 1987, now abandoned, which is a continuation-in-part of Ser. No. 766,330 filed Aug. 16, 1985, now abandoned.

BACKGROUND OF THE INVENTION

This invention is directed to clear or transluscent liquid detergents that are unbuilt or built with water-soluble builders. Such detergents generally comprise 1 to 60% surfactants; up to 5% foam control agents; up to 10% water-soluble detergent builders; 0.1 to 2% of an active agent which can provide anti-redeposition, viscosity-modifying, and improved cleaning performance functions; and remainder to 100% of water and other ingredients. In a preferred embodiment, the active agent is a water-soluble or water-dispersible polymer of an alpha-beta ethylenically unsaturated lightly crosslinked lower aliphatic carboxylic acid having molecular weight in the range of about one-half million to 5 million, measured at room temperature. Such detergents are particularly effective on cotton and cotton/polyester fabrics.

As already noted, the active agent that is used in liquid laundry detergent compositions disclosed herein can provide the functions of soil anti-redeposition, viscosity modification, and improved cleaning performance. This agent has been used in detergent compositions in the past and is identified in the prior art as neutralized crosslinked polyacrylate polymer, as modified polyacrylic thickening agent, and as sodium polyacrylate. The prior art discloses the use of the active agent at a level of about 0.1 to 2% by weight of total composition.

British patent 2,079,305 describes built liquid enzymatic detergents containing, inter alia, an enzyme, a polyol, boric acid, and a neutralized crosslinked polyacrylate polymer. The polyacrylate polymer is described as being water-soluble polymer of acrylic acid crosslinked with not more than 10% of a cross-linking agent containing a vinyl group. Specific examples of the polyacrylate polymer noted in this patent include Carbopol ® 934, 940 and 941, products of The B. F. Goodrich Company, assignee of the invention claimed herein. Amount of the polyacrylate polymer is disclosed as 0.1 to 2% by weight of the total detergent composition. The use of a polyol, boric acid, and a polyacrylate polymer in liquid enzymatic detergents results in stable aqueous, built enzymatic liquid detergents which have satisfactory enzyme stability, especially at higher pH, as well as storage stability.

The unbuilt liquid laundry detergents disclosed herein are patentable over the British patent since the patent does not teach nor suggest the use of a polyacrylate polymer in conjunction with unbuilt liquid enzymatic detergents. This is based on disclosure in lines 21–26 of the patent where it is stated that the use of a polyol and boric acid in certain ratio has been suggested in the prior art. Although this patent does teach the use of a polyacrylate polymer in built liquid detergents in conjunction with a polyol and boric acid, this patent discloses at middle of column 2, on page 2 that all kinds of builders can also be used. Although any builder appears suitable for use in the liquid enzyme detergents disclosed by the British patents, only water-soluble builders are suitable in the liquid laundry detergents described herein. It is also important to note that this patent discloses at bottom of column 2, on page 2 that other conventional materials can also be present in the liquid enzymatic detergents. Many different conventional materials are listed, including soil suspending agents. Polyacrylate polymers were not known as soil-suspending agents at time of the filing of the patent application which matured into the British patent. The prior art, at that time, recognized the use of carboxymethyl cellulose and other materials disclosed at top of column 10 of U.S. Pat. No. 4,092,273, as known soil suspending agents. Carboxymethyl cellulose is effective on cotton but ineffective on cotton/polyester blends. It is believed that the use of polyacrylate polymers, and other suitable polymers disclosed herein, as soil suspending agents was discovered by applicants and is disclosed for the first time. Therefore, the use of polyacrylate polymers, and other cognate materials disclosed herein, as suspending agents, would eliminate the use of the conventional soil suspending agents. Furthermore, the invention disclosed herein does not rely on the interaction of a polyol, boric acid and a polyacrylate to obtain a liquid detergent having satisfactory enzyme stability as well as satisfactory physical storage stability.

U.S. Pat. No. 4,147,650 describes slurry detergents comprising alkali metal hydroxides and/or silicates, condensed phosophates, sodium hypochlorite, and sodium polyacrylate. This patent asserts that slurry detergents are more advantageous than granular or liquid detergents since the granular detergents are subject to caking and the liquid detergents are limited in their strength by the solubility of their ingredients. This patent also asserts that the disclosed slurry detergent makes it possible to use more complex phosphates and alkaline ingredients since a slurry does not require a true solution. A slurry, as described by this patent, is a mass of semi-fluid ingredients of relatively homogenous nature. Sodium polyacrylate acts synergistically with sodium tripolyphosphate to form a homogeneous suspension in slurry form, thus facilitating uniform and complete dispersion. As long as no more than 30% of sodium tripolyphosphate and 5% of sodium tripolyphosphate is used, a satisfactory slurry is formed. If more is used, the mass becomes too viscous or may solidify. Minimum amount of tripolyphosphate is 5% and that for polyacrylate is 1%, on dry weight basis. Generally, amount of the polyacrylate in the detergent composition can be in the range of 1 to 10% by weight, on anhydrous basis.

The liquid detergent compositions disclosed herein are patentable over U.S. Pat. No. 4,147,650 because the ingredients thereof are wholly soluble therein and the liquid detergent compositions are, for that reason, clear or transluscent, in absence of pigment. As is apparent from the above discussion, the ingredients in the slurry detergent compositions are not wholly soluble therein by definition, and thereby, are not clear or transluscent. Furthermore, although sodium tripolyphosphate can be present in liquid detergents described herein, it can be present up to its solubility limit of about 10% in water. Therefore, since sodium tripolyphosphate can be absent from the liquid detergents disclosed herein, the synergism between it and sodium polyacrylate, relied on by U.S. Pat. No. 4,147,650, would also be absent, indicating a different kind of detergent.

U.S. Pat. No. 4,215,004 is also directed to slurry detergent compositions. These detergents are heavy duty, built detergents containing an alkali metal hydroxide, detergents, sodium polyacrylate, a modified polyacrylic acid, and water insoluble aluminosilicate ion exchange material and/or complex phosphates, as well as other conventional additives.

The liquid detergent compositions disclosed herein are patentable over U.S. Pat. No. 4,215,004 for the same reasons presented in connection with U.S. Pat. No. 4,147,650. Principally, the basic distinction is that inherent in a liquid detergent as compared to a slurry detergent.

U.S. Pat. Nos. 4,092,273 and 4,368,147 relate to liquid detergents and both emanate from the same parent application. The detergents disclosed in these patents have viscosity of 40 to 120 cps at 24° C., contain nonionic surfactants, an alkanol, a viscosity prevention agent, and water. In one patent, the viscosity control agent is a water soluble salt of a dicarboxylic acid whereas in the other patent, the viscosity control agent is sodium or potassium formate in conjunction with the alkanol. These two patents are noted only as being illustrative of liquid detergent compositions.

SUMMARY OF THE INVENTION

Liquid detergents are disclosed herein which are clear or transluscent and are characterized by the presence of water-soluble sequester builders and an active ingredient which provides anti-redeposition, viscosity-modifying, and improved cleaning performance functions. The active ingredient is preferably a polymer of acrylic acid having molecular weight of about one-half million to five million, which is used at a level of 0.05 to 5%, based on the weight of the liquid detergent composition.

DETAILED DESCRIPTION OF THE INVENTION

This invention is directed to clear or transluscent liquid detergents which are non-enzymatic and devoid of boric acid or equivalent thereof. This property of these detergents is due to the fact that all of the ingredients are water-soluble and are completely solubilized. Their pH is generally in the range of about 6 to 12, preferably under 10, such 8–10. Most preferably, detergents have a nearly neutral pH. Such detergents have viscosity of 40 to 200 cps at 24° C. and are readily pourable at room temperature. This class of detergents includes unbuilt and built liquid detergents containing water-soluble sequester builders such as citrates, soap, linear polyacrylates, and the like. Sodium carbonate, for instance, is not a sequestrant builder. Amount of surfactants in these detergents can vary from 1 to 60%, preferably 10 to 40%; up to 20% and preferably 1 to 10% of water-soluble sequester builders; 0.05 to 5%, preferably 0.1 to 2%, of an active agent which can provide anti-redeposition, viscosity-modifying, and improved cleaning performance functions; and water and other conventional additives to make up 100% by weight of a liquid detergent composition. These liquid detergents can also be formulated to exclude guar material and dialkyl sulphosuccinates.

The liquid detergents described herein differ in character from the slurry detergents known in the prior art. A slurry detergent is a mass of semi-fluid ingredients of relatively homogeneous nature that is not a true solution. Since a slurry is not a true solution, slurry detergents allow the use of more complex phosphates and alkaline ingredients since these ingredients need not be completely solubilized. Where used, a polyacrylate acts synergistically with tripolyphosphate to suspend the other ingredients in a slurry detergent which are not completely solubilized.

The active agent noted herein when used in a liquid detergent provides significant advantages over prior art liquid detergents which are devoid of such active agents. When used at recommended level in liquid detergents, the active agents provide soil anti-redeposition function and improved cleaning performance, as verified on cotton and cotton/polyester blend fabrics. This is surprising since carboxymethyl cellulose, a known anti-redeposition agent for cotton, is ineffective on cotton/polyester blended fabrics although it is known to be effective on cotton. Additionally, such active agents impart viscosity control character in that liquid detergents formulated therewith have a nearly constant viscosity within an acceptable pourable range of about 40–200 cps irrespective of widely differing levels of anionic and/or nonionic surfactants. Viscosity of such liquid detergents can be maintained in the pourable range when varying amounts and relative ratios of anionic and nonionic surfactants between about 10 and 35%, based on the weight of the total liquid detergent. When mixtures of surfactants are used, such as anionic and nonionic surfactants, relative ratio thereof can vary from 10/1 to 1/10, preferably 6/1 to 1/6.

The water-soluble sequestrant builders suitable herein can be used in amounts varying up to 20%, preferably 1 to 10% by weight of the total liquid detergent composition. The amounts of the builders given herein are subject to the condition that they be completely soluble in the composition. The water-soluble sequestrant builders are those which reduce the free calcium and magnesium ion concentration in the wash system down to the desired levels (usually less than about 5 ppm as calcium carbonate) via formation of soluble complexes with calcium and magnesium ions. Examples of such builders include alkali metal and particularly sodium citrate, alkali metal and particularly sodium laurate, alkali metal silicates, linear polyacrylates, tetrapotassium pyrophosphate, etc. Other builders that are not soluble to the extent used or which are not also sequestrants can be used but only to the limit of their solubility in the liquid detergent composition. For instance, sodium tripolyphosphate is soluble in water up to about 10% whereas tetrapotassium pyrophosphate is soluble in water up to about 25%. Therefore, in conformity with the spirit of this invention, such builders can be used but only to the extent of their solubility in the liquid detergent composition. In a preferred embodiment, however, suitable builders are selected from water-soluble sequestrant builders described above.

The sequestrant builders are separate and different from the active agents. The sequestrant builders exclude the active agents and the active agents, as defined herein, exclude the sequestrant builders.

Suitable surfactants are selected from anionic, nonionic, cationic, zwitterionic or amphoteric materials. Surfactants are used at a level of 5 to 50%, preferably 10 to 40%, based on the weight of the liquid detergent composition. Mixtures of surfactants can be used, particularly mixtures of anionic and nonionic surfactants.

Examples of suitable anionic synthetic surfactants are salts of $C_8$ to $C_{20}$ alkylbenzene sulfonates, $C_8$ to $C_{22}$ primary or secondary alkane sulfonates, $C_8$ to $C_{24}$ olefin sulfonates, sulfonated polycarboxylic acids prepared by sulfonation of pyrolyzed product of alkaline earth metal citrates, $C_8$ to $C_{22}$ alkyl sulfonates, $C_8$ to $C_{24}$ alkylpolyglycolether sulfonates containing up to 10 mols of ethylene oxide, and the like. Suitable salts herein refer particularly to sodium, potassium, ammonium, and substituted ammonium salts such as mono-, di-, and triethanolamine salts. Other examples of suitable anionic surfactants are described in "Surface Active Agents and Detergents" Vol. I and II) by Schwatz, Perry and Berch. In a preferred embodient, the anionic surfactants are selected from the group consisting essentially of anionic sulfonate and sulphate surfactants.

Examples of nonionic synthetic detergents or surfactants are condensation products of ethylene oxide, propylene oxide and/or butyleneoxide with $C_8$–$C_{18}$ alkylphenols, $C_8$–$C_{18}$ primary or secondary aliphatic alcohols, $C_8$–$C_{18}$ fatty acid amides. Other examples of nonionics include tertiary amine oxides with one $C_8$–$C_{18}$ alkyl chain and two $C_{1-3}$ alkyl chains. The above reference also describes further examples of nonionics.

The average number of moles of ethylene oxide and/or propylene oxide present in the above various nonionics varies from 1–30; mixtures of nonionics, including mixtures of nonionics with a lower and a higher degree of alkoxylation, may also be used.

Examples of cationic surfactants are the quaternary ammonium compounds such as alkyldimethylammonium halogenides, but such cationics are less preferred for inclusion in enzymatic detergent compositions since their use may lead to incompatibility.

Examples of amphoteric or zwitterionic detergents are N-alkylamino acids, sulphobetaines, condensation products of fatty acids with protein hydrolysates, but owing to their relatively high costs, they are usually used in combination with anionic of a nonionic detergent.

Mixtures of the various types of surfactants may also be used, and preference is given to mixtures of an anionic and a nonionic surfactants. Soaps, in the form of their sodium, potassium, and substituted ammonium salts such as of polymerized fatty acids, may also be used, preferably in conjunction with an anionic and/or a nonionic synthetic detergent.

The active ingredient, referred to above, has shown to be particularly effective on cotton and cotton/polyester blended fabrics in terms of soil anti-redeposition and improved cleaning performance. Additionally, the active ingredient is effective as a viscosity control agent in maintaining viscosity of the liquid detergent compositions essentially constant in the pourable range of 40 to 200 cps, measured at 24° C. For clear liquid detergents based on nonionic surfactants alone, 0.1% of the active ingredient yields both viscosity control and antiredeposition as well as improved cleaning performance. However, for liquid detergents based on anionic surfactants alone, 0.5% of the active ingredient is needed to achieve both viscosity control and antiredeposition as well as improved cleaning performance.

The active agents suitable herein are selected from synthetic agents. The synthetic agents contemplated herein include commercially available polymeric agents, such as Carbopol ® agents, available from The B.F. Goodrich Company, and other Polymeric agents sold under tradenames such as Acrisint ®, Junlon ®, Rheogic ®, Acrysol ®, Alcoprint ®, EMA ®, Gaftex ®, and Polycarbophil ® polymeric materials. Particular agents in this group found suitable herein include Carbopol 615, 676, 940, 941 and 1342 resins, which are available from The B.F. Goodrich Company; Acrisint 310 agent, available from Sigma Chemical Company; Junlon PW-150 and remainder of this series, available from Showa Tsusho Company of Japan; Rheogic series, available from Showa Tsusho Company of Japan; Hiviswako 103 and the rest of that series, available from Wako Pure Chemical Industries of Japan; Acrysol ICS-1 and related agents, available from Rohm & Haas; Alcoprint PTF and the related agents, available from Allied Colloids of Great Britain; EMA-91 and related agents, available from Monsanto Company; and Gaftex PT and similar agents, available from GAF Corporation.

Synthetic agents are generally selected from carboxyl containing polymers and polyamides. Preferred agents are selected from homopolymers of an acrylic acid, homopolymers of alkyl acrylates, and copolymers of an acrylic acid or an acrylic ester with suitable comonomers or with each other. Such agents can be non-crosslinked or lightly crosslinked and can be functionally identified as water-soluble or water-swellable. The lightly crosslinked materials herein are crosslinked with up to about 10% by weight of a suitable crosslinking agent, preferably up to 5%, and especially 0.01 to 2%. The non-crosslinked synthetic agents are generally soluble in water whereas the lightly crosslinked agents are generally swellable in water although there are some exceptions to these generalizations. In one instance, one such agent is water-swellable although it is not crosslinked. At times, it is difficult to differentiate between water-soluble and water-swellable agents since some are water-soluble and water dispersible.

More particularly, the principal class of synthetic agents suitable herein are the polyacrylic acids which can be homopolymers of an alpha, beta-olefinically unsaturated monocarboxylic acid of 3 to 5 carbon atoms and copolymers thereof with one or more suitable comonomers. The acrylic acid copolymers are selected from copolymers of one or more monounsaturated monocarboxylic acid of 3 to 5 carbon atoms copolymerized with up to about 20% by weight, preferably 1 to 10% by weight, of one or more other copolymerizable monomers. Preferred acrylic acids for use in this invention have the following general structure:

$$CH_2{=}\overset{\overset{\displaystyle R}{|}}{C}{-}COOH$$

wherein R is a substituent selected from the class consisting of hydrogen, halogen, and the cyano (—C≡N) groups, monovalent alkyl radicals, monovalent aryl radicals, monovalent aralkyl radicals, monovalent alkaryl radicals, and monovalent cycloaliphatic radicals. Of this class, acrylic and methacrylic acids are most preferred because of generally lower cost, ready availability and ability to form superior polymers.

Suitable comonomers are selected from alkyl acrylates represented by the following formula

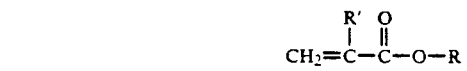

where R′ is hydrogen, methyl, or ethyl group; and R is an alkyl group of 10 to 30, preferably 10 to 20 carbon atoms; R can also be selected from alkyl, alkoxy, haloalkyl, cyanoalkyl, and the like groups, containing 1 to 9 carbon atoms. Representative acrylates include methyl acrylate, ethyl acrylate, propyl acrylate, butyl acrylate, methyl methacrylate, methyl ethacrylate, octyl acrylate, octyl methacrylate, 2-ethylhexyl acrylate, n-hexyl methacrylate, isodecyl methacrylate, lauryl acrylate, stearyl acrylate, behenyl acrylate, melissyl acrylate and the corresponding methacrylates. Mixtures of two or three or more of the acrylic esters may be successfully polymerized with one of the carboxylic acid monomers. One useful class of copolymers are those methacrylates where the alkyl group contains 10 to 20 carbon atoms. Typical polymers have been made with about 15 weight percent isodecyl methacrylate, about 10 weight percent lauryl methacrylate, and about 7 weight percent stearyl methacrylate, with acrylic acid.

Other vinylidene comonomers may also be used, particularly in conjunction with acrylic esters, including the acrylic nitriles, olefinically unsaturated nitriles useful in the interpolymers embodied herein, preferably the monoolefinically unsaturated nitriles having from 3 to 10 carbon atoms such as acrylonitrile, methacrylonitrile, and the like. Most preferred are acrylonitrile and methacrylonitrile. The amounts used, for example, for some polymers are from about 5 to 30 weight percent of the total monomers copolymerized.

Acrylic amides include monoolefinically unsaturated amides that may be incorporated in the interpolymers of this invention having at least one hydrogen on the amide nitrogen and the olefinic unsaturation is alpha-beta to the carbonyl group. Very much preferred are acrylamide and methacrylamide used in amounts, for example, from about 1 to 30 weight percent of the total monomers copolymerized. Other acrylic amides include N-alkylol amides of alpha, beta-olefinically unsaturated carboxylic acids including those having from 4 to 10 carbon atoms. The preferred monomers of the N-alkylol amide type are the N-alkylol amides of alpha, beta-monoolefinically unsaturated monocarboxylic acids and the most preferred are N-methylol acrylamide and N-methylol methacrylamide used in amounts, for example, of about 1 to 20 weight percent. N-alkoxymethyl acrylamides also may be used. The preferred alkoxymethyl acrylamides are those wherein the alkyl group contains from 2 to 5 carbon atoms and useful is N-butoxymethyl acrylamide.

Other vinylidene comonomers generally include, in addition to those described above, at least one other olefinically unsaturated monomer, more preferably at least one other vinylidene monomer (i.e., a monomer containing at least one terminal $CH_2{=}C<$ group per molecule) copolymerized therewith, for example up to about 30% or more by weight of the total monomers. Suitable monomers include α-olefins containing from 2 to 12 carbon atoms, such as ethylene and propylene; dienes containing from 4 to 10 carbon atoms, including butadiene; vinyl esters and allyl esters such as vinyl acetate; vinyl aromatics such as styrene; vinyl and allyl ethers and ketones such as vinyl methyl ether and methyl vinyl ketone; cyanoalkyl acrylates such as α-cyanoalkyl acrylates, the α-, β- and-cyanopropyl acrylates, vinyl halides and vinyl chloride, vinylidene chloride and the like; esters of maleic and fumaric acid and the like.

Guar gum is deleterious to detergency and whiteness retention when included in detergent formulations containing the active agent described herein. For instance, formulations A and B were formulated in the same way as herein and had the following composition and results:

| | A | B |
|---|---|---|
| Sodium lauryl sulfate | 7.2 | 7.2 |
| Sodium lauryl ether sulfate | 8.8 | 8.8 |
| Coconut monoethanolamide | 4.0 | 4.0 |
| Guar gum | — | 0.30 |
| Carbopol ® 934 resin | 0.65 | 0.35 |
| % Detergency | 27.9 | 26.5 |
| % Whiteness retention (cotton) | 93.7 | 93.5 |

The detergency results were obtained pursuant to ASTMD 3050-75 test and whiteness retention on cotton cloth results were obtained pursuant to ASTMD 4008-81 test.

It should be apparent from the above data that presence of guar gum in detergent formulations in place of a portion of a carboxyvinyl polymer (Carbopol ® resin) is deleterious in terms of detergency and whiteness retention.

The polyacrylic acids described herein can be cross-linked with a suitable polyfunctional vinylidene monomer containing at least two terminal $CH_2{=}C<$ groups, including for example, butadiene, isoprene, divinyl benzene, divinyl naphthalene, allyl acrylates and the like. Particularly useful cross-linking monomers for use in preparing the copolymers, if one is employed, are polyalkenyl polyethers having more than one alkenyl ether grouping per molecule. The most useful possess alkenyl groups in which an olefinic double bond is present attached to a terminal methylene groups, $CH_2{=}C<$. They are made by the etherification of a polyhydric alcohol containing at least 4 carbon atoms and at least 3 hydroxyl groups. The product is a complex mixture of polyethers with varying numbers of ether groups. Analysis reveals the average number of ether groupings on each molecule. Efficiency of the polyether cross-linking agent increases with the number of potentially polymerizable groups on the molecule. It is preferred to utilize polyethers containing an average of two or more alkenyl ether groupings per molecule. Other cross-linking monomers include, for example, diallyl esters, dimethallyl ethers, allyl or methallyl acrylates and acrylamides, tetraallyl tin, tetravinyl silane, polyalkenyl methanes, diacrylates, and dimethacrylates, divinyl compounds as divinyl benzene, polyallyl phosphate, diallyloxy compounds and phosphite esters and the like. Typical agents are allyl pentaerythritol, allyl sucrose, trimethylolpropane triacrylate, 1,6-hexanediol diacrylate, trimethylolpropane diallyl ether, pentaerythritol triacrylate, tetramethylene dimethacrylate, tetramethylene diacrylate, ethylene diacrylate, ethylene dimethacrylate, triethylene glycol dimethacrylate, and the like. Allyl pentaerythritol, allyl sucrose and trimethylolpropane diallyl ether provide excellent polymers in amounts less than 5, as less than 3 weight percent, and particularly about 0.1 to 2.0% by weight of all monomers.

For purposes of clarification, it is pointed out that, generally speaking, the lightly crosslinked synthetic thickeners described herein swell in water whereas the non-crosslinked thickeners are soluble in water. Both types, however, are suitable in the invention herein.

The preferred polyacrylic acid homopolymers and copolymers useful herein, as described, include crosslinked and non-crosslinked polymers prepared in an organic solvent, especially benzene, with molecular weights in the range of about 100,000 to 10,000,000. Especially preferred are lightly crosslinked polyacrylic acid homopolymers of acrylic acid itself in the molecular weight range of about 200,000 to 5,000,000. The polyacrylic agents are in acid form which are neutralized to a salt form for use in the invention described herein.

Other suitable polycarboxylic resins are lightly crosslinked, swellable resin polymers containing a carboxylic acid as a major component. These materials are polymerized in an aqueous solution of a soluble nonredox divalent inorganic ion, such as magnesium sulfate. The salt is normally used at a level of above about one-half molar. The major component can be homopolymerized or copolymerized with a suitable comonomer. Suitable carboxylic acids include monounsaturated monocarboxylic and dicarboxylic acids containing 3 to 5 carbon atoms, salts thereof and anhydrides thereof. Specific examples thereof include acrylic acid and salts thereof, methacrylic acid and salts thereof, fumaric acid, maleic acid and its anhydride, itaconic acid, and the like. Acrylic acid is preferred. Polyunsaturated copolymerizable crosslinking agents, which form a minor component of these resins, have two or more double bonds subject to crosslinking with the monomers and can be aromatic or aliphatic. As disclosed in Example 1 of U.S. Pat. No. 2,810,716, such resins can be obtained by preparing a mixture of 100 grams of acrylic acid, 1.2g of divinyl benzene, and 1.0g of benzoylperoxide. This mixture is added to an aqueous saturated magnesium sulfate solution and heated to 95° C. After 16 minutes, 100.5g of the resin is obtained, which is highly swelling. Such resins are well known in the art.

Other conventional materials may also be present in the liquid detergent compositions of the invention, for example hydrotropes, corrosion inhibitors, dyes, perfumes, silicates, optical brighteners, suds boosters, suds depressants such as silicones, germicides, anti-tarnishing agents, pacifiers, fabric softening agents, oxygen-liberating bleaches such as hydrogen peroxide, sodium perborate or percarbonate, diperisophthalic anhydride with or without bleach precursors, reducing bleaches such as sodium sulphite, buffers and the like.

The liquid laundry detergents are presently known. The labels of the major U.S. and West European liquid laundry detergents indicate that such detergents are either unbuilt or built with water-soluble, weak detergent builders such as sodium citrate, sodium laurate, and the like. These detergents are also clear or translucent, have approximately a neutral pH, and have a pourable viscosity of 40 to 200 cps. Their formulations are generally as follows:

| | |
|---|---|
| surfactants | 15–40% |
| foam controlling agents | 0–5% |
| soluble detergent builders | 0–10% |
| viscosity control agents | 2–10% |
| water, perfume, color, etc. | to 100% weight |

The above formulations cover built and unbuilt detergents since the level of builders varies from 0 to 10%. An unbuilt detergent, of course, contains no detergent builder whereas a built detergent contains an amount of up to 10% by weight of a water-soluble detergent builder.

The above formulations are devoid of the active agent described herein. When liquid detergents are prepared pursuant to the invention disclosed herein, amount of a viscosity control agent will vary from about 0.05 to 5%, and preferably 0.1 to 2%, by weight. It should be apparent that the liquid laundry detergent prepared as described herein will not only contain less than one-half of a different viscosity control agent, but the detergents will be more versatile and more effective not only on cotton but also on blends of cotton and polyester. The effectiveness referred to herein pertains to anti-redeposition, improved cleaning performance, and to viscosity control.

The examples that follow demonstrate the invention described herein in terms of liquid laundry detergents and their effectiveness to maintain viscosity control and in anti-redeposition and improved cleaning.

For the examples that follow, a number of different active agents were used to demonstrate the asserted advantages. The active agents that were tested were Carbopol materials 941 and 1342, both of which are available from The B.F. Goodrich Company. Molecular weight and aqueous solutions of these active agents are defined as follows:

| Molecular Wt. Viscosity (cps) | C-941 1,250,000 | C-1342 1,000,000 |
|---|---|---|
| 0.5% min. | 4,000 | — |
| 0.5% max. | 10,000 | — |
| 1.0% min. | — | 10,000 |
| 1.0% max. | — | 30,000 |

EXAMPLE 1

This example demonstrates the function of certain active agents in anionic and nonionic surfactants. Two typical anionic and three typical nonionic surfactants were tested. The following anionic surfactants were tested:

(a) straight chain dodecylbenzene sodium sulfate, commercially available as Conoco C-550 from Conoco Chemicals, a division of Conoco, Inc.; and (b) sodium alpha olefin sulfonate, commercially available as Conco AOS-40 from Continental Chemical Company.

The following nonionic surfactants were tested:

(1) modified oxyethylated straight chain alcohol with an HLB value of 10.0, commercially available as Plurafac RA-20 from BASF Wyandotte Corporation;

(2) $C_{12-15}$ linear primary alcohol ethoxylated with an HLB value of 12.0, commercially available as Neodol 2507 from Shell Chemical Company; and (3) nonylphenoxy polyethoxy ethanol with an HLB value of 12.2, commercially available as Surfonic N-95 from Jefferson Chemical Company.

Although Plurafac RA-20 and Neodol 25-7 nonionic surfactants are structurally similar, they vary widely in their viscosity behavior, due probably to a slight variation in alkyl chain distribution and/or number of ethylene oxide units.

Experimental liquid detergent samples were prepared by following procedure: Step 1: prepare 1.0% of the Carbopol resin stock mucilages and adjust them to pH of 8.0; Step 2: mix appropriate quantities of the stock mucilages and specified surfactants (adjusted to pH of 8.0) to give the desired product compositions; Step 3: readjust pH of the resulting liquid detergent product to pH of 8.0+0.5, employing 10% sodium hydroxide. Apparent viscosities of such samples were determined employing a Brabender Rheotron Bob and Cup rotational viscometer at 30° C. and at a shear rate of 144/sec. The active agent was preneutralized to pH of 8.0 before it was mixed with a surfactant. The surfactant was also preneutralized to pH of 8.0. Results in terms of viscosity (cps) for the five surfactants and the two active agents are given in Table I, below:

TABLE I

| % Anionic S. C-550 | No Carbopol | 0.5% C-941 | 0.5% C-1342 |
|---|---|---|---|
| 10 | 2.18 | 59.07 | 159.10 |
| 15 | 5.12 | 17.32 | 102.10 |
| 20 | 22.9 | 62.8 | 80.24 |
| 25 | 201.71 | 240.72 | 71.94 |
| 30 | 664.05 | 597.65 | 96.29 |
| 35 | 1660.13 | 664.05 | 207.52 |
| % Anionic S. AOS-40 | | | |
| 10 | 1.45 | 61.91 | 116.21 |
| 15 | 2.00 | 22.51 | 66.68 |
| 20 | 2.88 | 14.12 | 43.72 |
| 25 | 4.40 | 12.52 | 32.93 |
| 30 | 6.75 | 13.29 | 33.76 |
| 35 | 13.06 | — | — |

| % Nonionic S. RA-20 | No Carbopol | 0.05% C-941 | 0.1% C-941 | 0.1% C-1342 |
|---|---|---|---|---|
| 10 | 1.70 | 44.82 | 178.46 | 212.50 |
| 15 | 2.56 | 36.80 | 152.18 | 185.10 |
| 20 | 5.11 | 35.97 | 163.25 | 149.96 |
| 25 | 10.35 | 49.80 | 160.20 | 171.55 |
| 30 | 21.68 | 72.49 | 190.91 | 224.12 |
| 35 | 43.09 | 116.21 | 259.81 | 282.22 |

| % Nonionic S. Neodal 25-7 | No Carbopol | 0.1% C-941 | 0.1% C-1342 |
|---|---|---|---|
| 10 | 18.54 | 332.86 | 423.33 |
| 15 | 79.69 | 641.92 | 639.15 |
| 20 | 294.67 | 1037.58 | 1109.52 |
| 25 | 705.55 | 1541.15 | 1657.36 |
| 30 | 1245.1 | — | — |

| % Nonionic S. Surfonic N-95 | No Carbopol | 0.05% C-941 | 0.1% C-941 | 0.1% C-1342 |
|---|---|---|---|---|
| 10 | 9.28 | 162.69 | 381.00 | 473.14 |
| 15 | 30.14 | 234.08 | 558.91 | 581.04 |
| 20 | 85.77 | 348.63 | 816.23 | 788.56 |
| 25 | 215.82 | 558.91 | 965.64 | 1162.09 |
| 30 | 456.53 | 913.07 | 1577.12 | 1535.62 |
| 35 | 733.22 | — | — | — |

The above data demonstrates several important factors. The active agents at levels of 0.1 to 0.5% in the experimental liquid detergents exhibited a very striking viscosity moderating effect by maintaining viscosity of the detergents very nearly constant and within the pourable range, even when the surfactant level was varied widely between 10 and 35%. This is self-evident for the data for nonionic surfactant Plurafac RA-20, anionic surfactant Conoco C-550, and anionic surfactant Conco AOS-40.

This viscosity moderating role of the active agent is expected to provide formulating cost benefit and flexibility in the compounding of commercial liquid detergent compositions.

The viscosity moderating effect of the active agents described herein is unexpected in view of the corresponding agents used presently, such as ethanol, propanol, sodium formate, potassium formate, sodium adipate, and the like, which specifically uniformly decrease viscosity at every surfactant concentration. Other viscosity moderating agents presently used have the opposite effect, i.e., increase viscosity uniformly at every surfactant concentration and act as plain thickeners. Examples of agents in this group include glycerin, propylene glycol, or any polyol. Therefore, neither of these groups of agents provides a near constant viscosity irrespective of surfactant concentration over a wide latitude.

With certain commercial active agents, the viscosity control was not achieved. This applies to the nonionic surfactants Neodol 25-7 and Surfonic N-95 materials. With these surfactants, the active agents behaved more like conventional thickening agents rather than as viscosity moderators. In these instances, the addition of 0.1% of an active agent, increased viscosity uniformly at each surfactant concentration.

This experiment demonstrates another feature of the invention. Whereas conventional viscosity moderating agents are used at levels of 2 to 10%, the herein-disclosed active agents are used at only about 0.1% level. The difference is very substantial, even if only considered on the weight basis. Furthermore, whereas the herein-disclosed active agents also provide anti-redeposition and improved cleaning performance, the conventional viscosity moderating agents do not.

EXAMPLE 2

This example demonstrates cleaning performance or detergency and anti soil redeposition function of certain active agents in liquid detergent compositions. The detergency test used was ASTMD 3050-75, which is a standard method for measuring soil removal from artificially soiled fabrics. The anti soil redeposition test used was ASTM D4008-81, which is a standard method for measuring anti soil deposition properties of laundry detergents. Standard cotton and cotton/polyester fabrics were used. Whereas the tests prescribe 0.15% of a detergent composition, 0.3% was used in each test. Otherwise, conditions and materials prescribed by the tests were used. Results obtained with various compositions and on the particular fabrics are given in Table II, below:

TABLE II

| Series 1: % Nonionic Surfactant | % Detergency On Cotton | | % Whiteness Retention Cotton Fabric | | % Whiteness Retention Cotton/Polyester Fabric | |
|---|---|---|---|---|---|---|
| Neodol 25-7 in Water | No Carbopol | 0.1% C-941 | No Carbopol | 0.1% C-941 | No Carbopol | 0.1% C-941 |
| 20 | 46.3 | 49.1 | 91.5 | 92.3 | 81.3 | 81.3 |
| 25 | 47.4 | 51.0 | 91.4 | 92.5 | 79.6 | 82.3 |
| 20 | 46.3 | 47.1 | 91.5 | 92.2 | 81.3 | 81.7 |

Series 2:

TABLE II-continued

| Commercial Detergent "Wisk" | % C-941 added to "Wisk" 0 | 0.5% | 1.0% | 2.0% |
|---|---|---|---|---|
| % Whiteness Retention on Cotton | 96.1 | 96.6 | 98.2 | 98.7 |

| Series 3: % Anionic Surfactant | % Detergency on Cotton | | | % Whiteness Retention: Cotton Fabric | | | % Whiteness Retention: Cotton/Polyester Blend | | |
|---|---|---|---|---|---|---|---|---|---|
| Conoco C-550 in Water | No Carbopol | 0.5% 941 | 0.5% 1342 | No Carbopol | 0.5% C-941 | 0.5% C-1342 | No Carbopol | 0.5% 941 | 0.5% 1342 |
| 20 | 3.0 | 3.3 | 3.5 | 92.9 | 92.2 | 92.0 | 75.1 | 79.8 | 80.6 |

| Series 4: % Anionic Surfactant | % Detergency on Cotton | | | % Whiteness Retention: Cotton Fabric | | | % Whiteness Retention: Cotton/Polyester Blend | | |
|---|---|---|---|---|---|---|---|---|---|
| Conco AOS-40 in Water | No Carbopol | 0.5% 941 | 0.5% 1342 | No Carbopol | 0.5% C-941 | 0.5% C-1342 | No Carbopol | 0.5% 941 | 0.5% 1342 |
| 20 | 25.6 | 26.1 | 25.0 | 93.9 | 92.8 | 93.8 | 85.5 | 86.1 | 86.1 |

The detergency tests were carried out to measure cleaning performance of the various liquid detergents. These tests were very similar to the whiteness retention tests which gave a measure of soil redeposition function. Whereas one wash cycle was used in the detergency test, ten wash cycles were used in the whiteness retention test.

In the discussion of the test results that follows, significant variation for the detergency tests is ±0.5% whereas significant variation for the whiteness retention tests is ±0.2%.

Series 1 samples of Table II consisted of the nonionic surfactant Neodol 25-7 in water at different concentrations. At 20% of the surfactant in water, detergency on cotton was 46.3% with no active agent and increased to 49.1% when 0.1% of Carbopol 941 active agent was added. It should be apparent to one skilled in the art that there is a difference of 2.8%, which is a very large and significant difference. At 25% of the surfactant, the corresponding difference was even greater at 3.6%. Another test was conducted at 20% surfactant with similar results.

The whiteness retention tests also yielded superior results. At 20% surfactant on cotton, whiteness retention was 91.5% with no active agent which increased to 92.3% when 0.1% of Carbopol 941 active agent was added. A difference here of 0.8% is very important and represents an important improvement. The whiteness retention, in this particular example, remained the same for the cotton/polyester blend.

At 25% surfactant, the whiteness retention was even more pronounced than at 20% surfactant concentration. On cotton, an improvement of 1.1% was measured whereas on cotton/polyester blend, an improvement of 2.7% was obtained. These results are incredible, especially when considered in the context that only 0.1% of the active agent was used.

In Series 2 samples, active agent Carbopol 941 was added to detergent "Wisk" at various levels and whiteness retention on cotton was measured. A very significant difference of 0.5% improvement in whiteness retention was measured when 0.5% of the active agent was added to the "Wisk" detergent. This difference improved further when more active agent was added.

In Series 3 and 4 samples, two other anionic active agents were tested on cotton fabric and cotton/polyester blends and showed very advantageous results when active agents described herein were incorporated.

We claim:

1. A liquid, non-enzymatic detergent composition devoid of boric acid or equivalent thereof that is clear or translucent, has pH or 8 to 10, is pourable at room temperature, and provides soil anti-redeposition function and improved cleaning performance comprising 10 to 40% of at least one surfactant selected from the group consisting of anionic sulfonate and sulphate surfactants, nonionic surfactants, cationic surfactants, amphoteric surfactants, and mixtures of such surfactants; 1 to 10% of at least one water-soluble sequester builder; and 0.1 to 2% of a water-soluble active agent having molecular weight in excess of about 100,000 selected from the group consisting of homopolymers of monounsaturated monocarboxylic and dicarboxylic acids of 3 to 5 carbon atoms and salts of such acids, copolymers thereof with 1 to 10% of one or more copolymerizable monomers, and mixtures of such homopolymers and copolymers; said copolymerizable monomers are selected from alkyl acrylates represented by the following formula

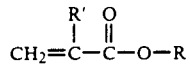

where $R^1$ is selected from hydrogen, methyl group, and ethyl group; and R is selected from alkyl groups of 10 to 30 carbon atoms, alkyl groups of 1 to 9 carbon atoms, alkoxy groups of 1, haloalkyl groups of 1 to 9 carbon atoms, cryanoalkyl groups of 1 to 0 carbon atoms, cyanoalkyl groups of 1 to 9 carbon atoms; acrylic nitriles of 3 to 10 carbon atoms, acrylic amides with at least one hydrogen on the amide nitrogen with olefinic unsaturation in the alpha-beta position to the carbonyl carbon; α-olefins of 2 to 12 carbon atoms; dienes containing 4 to 10 carbon atoms; vinyl esters and allyl esters; vinyl aromatics; vinyl and allyl ethers and ketones; cyanoalkyl acrylates; vinyl chloride; vinylidene chloride; esters of maleic and fumaric acids; and mixtures thereof; and remainder to 100% by weight of water; amounts are based on the weight of said composition.

2. Composition of claim 1 wherein said active agent is selected from homopolymers of acrylic acid, methacrylic acid, mixtures of such acids, and salts thereof, copolymers thereof with up to 10% of one or more of said comonomers selected from the group consisting of alkyl acrylates and methacrylates of 10 to 20 carbon atoms in the alkyl group; said homopolymers and copolymers, in acid or salt form, have molecular weight in the range of 100, 000 to 10,000,000.

3. Composition of claim 2 wherein said surfactant is selected from said anionic sulfonate and sulfate surfactants; said active agent is selected from non-crosslinked active agents which are water-soluble and lightly crosslinked active agents which are water-swellable, said active agent imparts viscosity control to said composition whereby said composition remains pourable at room temperature even in the presence of large amounts of said surfactant; and said composition is aqueous and has viscosity of 40 to 200 cps measured at 24° C.

4. Method of washing in an aqueous medium fabrics selected from cotton and cotton/polyester fabrics with composition of claim 1.

5. A liquid, non-enzymatic detergent composition devoid of boric acid or equivalent thereof, devoid of guar material, and devoid of dialkyl sulphosuccinate, that is clear or translucent, has pH of 8 to 10, is pourable at room temperature, and provides soil anti-redeposition function and improved cleaning performance comprising 10 to 40% of at least one surfactant selected from the group consisting of anionic sulfonate and sulphate surfactants, nonionic surfactants, cationic surfactants, amphoteric surfactants, and mixtures of such surfactants; 1 to 10% of at least one water-soluble sequester builder; and 0.1 to 2% of a water-soluble active agent having molecular weight in excess of about 100,000 selected from the group consisting of homopolymers of monounsaturated monocarboxylic and dicarboxylic acids of 3 to 5 carbon atoms and salts of such acids, copolymers thereof with 1 to 10% of one or more copolymerizable monomers, and mixtures of such homopolymers and copolymers; said copolymerizable monomers are selected from alkyl acrylates represented by the following formula

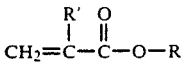

where $R^1$ is selected from hydrogen, methyl group, and ethyl group; and R is selected from alkyl groups of 10 to 30 carbon atoms, alkyl groups of 1 to 9 carbon atoms, haloalkyl groups of 1 to 9 carbon atoms, cyanoalkyl groups of 1 to 0 carbon atoms, cyanoalkyl groups of 1 to 9 carbon atoms; acrylic nitriles of 3 to 10 carbon atoms, acrylic amides with at least one hydrogen on the amide nitrogen with olefinic unsaturation in the alpha-beta position to the carbonyl carbon; α-olefins of 2 to 12 carbon atoms; dienes containing 4 to 10 carbon atoms; vinyl esters and allyl esters; vinyl aromatics; vinyl and allyl ethers and ketones; cyanoalkyl acrylates; vinyl chloride; vinylidene chloride; esters of maleic and fumaric acids; and mixtures thereof; and remainder to 100% of water; amounts are based on the weight of said composition.

6. Composition of claim 5 wherein said active agent is selected from homopolymers of acrylic acid, methacrylic acid, mixtures of such acids, and salts thereof, copolymers thereof with up to 10% of one or more of said comonomers selected from the group consisting of alkyl acrylates and methacrylates of 10 to 20 carbon atoms in the alkyl group; said homopolymers and copolymers, in acid or salt form, have molecular weight in the range of 100,000 to 10,000,000.

7. Composition of claim 6 wherein said surfactant is selected from said anionic sulfonate and sulfate surfactants; said active agent is selected from non-crosslinked active agents which are water-soluble and lightly crosslinked active agents which are water-swellable, said active agent imparts viscosity control to said composition whereby said composition remains pourable at room temperature even in the presence of large amounts of said surfactant; and said composition is aqueous and has viscosity of 40 to 200 cps measured at 24° C.

8. Method of washing in an aqueous medium fabrics selected from cotton and cotton/polyester fabrics with composition of claim 5.

* * * * *